US009420640B2

(12) United States Patent
Li et al.

(10) Patent No.: US 9,420,640 B2
(45) Date of Patent: Aug. 16, 2016

(54) ELECTRICAL HEATING DEVICE

(71) Applicant: GENTHERM GMBH, Odelzhausen (DE)

(72) Inventors: William (Wei) Li, Tianjin (CN); Sherry (Li) Chen, Langfang (CN); Luffy (Fei) Liu, Langfeng (CN); Jonathan (Yu) Zhang, Tianjin (CN)

(73) Assignee: GENTHERM GMBH, Odelzhausen (DE)

( * ) Notice: Subject to any disclaimer, the term of this patent is extended or adjusted under 35 U.S.C. 154(b) by 784 days.

(21) Appl. No.: 13/791,063

(22) Filed: Mar. 8, 2013

(65) Prior Publication Data

US 2014/0061183 A1 Mar. 6, 2014

(30) Foreign Application Priority Data

Aug. 29, 2012 (DE) ..... 10 2012 017 047

(51) Int. Cl.

| | |
|---|---|
| ***H05B 3/34*** | (2006.01) |
| ***H05B 3/54*** | (2006.01) |
| ***H05B 3/10*** | (2006.01) |
| ***H05B 1/00*** | (2006.01) |

(Continued)

(52) U.S. Cl.

CPC .. *H05B 3/34* (2013.01); *H05B 3/03* (2013.01); *H01C 7/027* (2013.01); *H05B 3/146* (2013.01); *H05B 2203/017* (2013.01); *H05B 2203/029* (2013.01)

(58) Field of Classification Search

CPC ..... H05B 2203/017; H05B 2203/02; H05B 2203/029; H05B 3/06; H05B 3/56; H05B 3/84; H05B 3/146; H05B 3/16; H05B 3/845; H01C 7/027

USPC ..... 219/528, 541, 549, 553, 522, 505, 548, 219/546, 219, 217, 203

See application file for complete search history.

(56) References Cited

U.S. PATENT DOCUMENTS

| | | | |
|---|---|---|---|
| 1,475,912 | A | 11/1923 | Williams |
| 1,553,461 | A | 9/1925 | Negromanti |

(Continued)

FOREIGN PATENT DOCUMENTS

| | | |
|---|---|---|
| DE | 3513909 | 10/1986 |
| DE | 3938951 A1 | 5/1990 |

(Continued)

OTHER PUBLICATIONS

Potentially related Patent Application, U.S. Appl. No. 13/256,318, published as 2013/0106147 on May 2, 2013.

(Continued)

*Primary Examiner* — Dana Ross
*Assistant Examiner* — Hemant Mathew
(74) *Attorney, Agent, or Firm* — The Dobrusin Law Firm, P.C.

(57) ABSTRACT

An electrical heating device including a heating resistor including a contacting device connecting the heating resistor to a current source. The contacting device includes a main electrode and a plurality of branch electrodes. The main electrode distributes current from the current source to a plurality of branch electrodes. The heating resistor includes one or more fire retardant recesses. The heating device includes one or more tire propagation blocker strips extending transversely to at least one of the plurality of branch electrodes.

18 Claims, 1 Drawing Sheet

Figure 1:
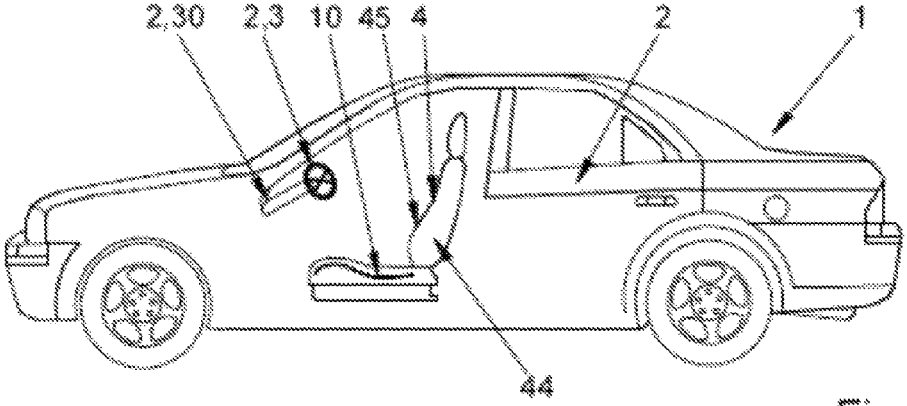

(51) Int. Cl.

| | |
|---|---|
| ***H05B 3/00*** | (2006.01) |
| ***H05B 11/00*** | (2006.01) |
| ***H05B 3/03*** | (2006.01) |
| *H05B 3/14* | (2006.01) |
| *H01C 7/02* | (2006.01) |

(56) References Cited

U.S. PATENT DOCUMENTS 2,409,421 A 10/1946 Dufault
2,978,972 A 4/1961 Hake
3,014,117 A 12/1961 Mading
3,221,145 A 11/1965 Hager
3,287,684 A 11/1966 Armbruster
3,448,246 A 6/1969 Armbruster
3,500,014 A 3/1970 Longo
3,721,799 A 3/1973 Carlstrom
3,832,527 A * 8/1974 Nagasima ..... B60S 1/586 200/61.05
3,877,788 A 4/1975 Sprague et al.
3,892,946 A 7/1975 Rimmi
3,995,140 A * 11/1976 Kuiff ..... H05B 3/84 200/61.05
4,032,752 A 6/1977 Ohmura et al.
4,044,221 A 8/1977 Kuhn
4,127,763 A * 11/1978 Roselli ..... B60S 1/586 15/250.05
4,149,066 A 4/1979 Niibe
4,245,149 A 1/1981 Fairlie
4,247,756 A 1/1981 Cucinotta et al.
4,335,725 A 6/1982 Geldmacher
4,399,347 A 8/1983 Schmitt
4,410,790 A 10/1983 Berf et al.
4,436,986 A 3/1984 Carlson
4,523,085 A 6/1985 Grise
4,533,821 A 8/1985 Sato
4,539,051 A 9/1985 Hacias
4,542,285 A 9/1985 Grise
4,626,664 A 12/1986 Grise
4,628,187 A * 12/1986 Sekiguchi ..... B60R 1/0602 219/505
4,628,188 A 12/1986 Andreasson
4,633,068 A 12/1986 Grise
4,656,339 A 4/1987 Grise
4,661,689 A 4/1987 Harrison
4,665,304 A 5/1987 Spencer
4,695,091 A 9/1987 Altmann et al.
4,713,531 A 12/1987 Fennekels et al.
4,719,335 A 1/1988 Batliwalla et al.
4,725,717 A 2/1988 Harrison
4,743,741 A 5/1988 Ramus
4,752,672 A 6/1988 Grise
4,761,541 A 8/1988 Batliwalla et al.
4,777,351 A 10/1988 Batliwalla et al.
4,845,343 A 7/1989 Aune et al.
4,849,255 A 7/1989 Grise et al.
4,857,711 A * 8/1989 Watts ..... H05B 3/845 219/203
4,868,898 A 9/1989 Seto
4,888,089 A 12/1989 Marstiller et al.
4,892,998 A 1/1990 Marstiller et al.
4,912,306 A 3/1990 Grise et al.
4,923,248 A 5/1990 Feher
4,931,627 A 6/1990 Watts
4,952,776 A 8/1990 Huguet
4,964,674 A 10/1990 Altmann et al.
5,015,824 A 5/1991 Monter et al.
5,019,797 A 5/1991 Marstiller et al.
5,025,136 A 6/1991 Doege et al.
5,034,594 A 7/1991 Beezhold et al.
5,045,673 A 9/1991 Kelly
5,057,674 A 10/1991 Smith-Johannsen
5,081,339 A 1/1992 Stine
5,111,025 A 5/1992 Barma et al.
5,132,840 A 7/1992 Okada et al.
5,155,334 A 10/1992 Marstiller et al.
5,181,006 A 1/1993 Shafe et al.
5,187,350 A 2/1993 Tsuchiya
5,197,595 A 3/1993 Coultas
5,198,639 A 3/1993 Smuckler
5,206,482 A 4/1993 Smuckler
5,335,381 A 8/1994 Chang
5,344,591 A 9/1994 Smuckler
5,354,966 A 10/1994 Sperbeck
5,405,178 A 4/1995 Weingarten et al.
5,414,241 A 5/1995 Ohashi et al.
5,418,025 A 5/1995 Harmand et al.
5,422,462 A 6/1995 Kishimoto
5,432,322 A 7/1995 Ingram et al.
5,451,747 A 9/1995 Sullivan et al.
5,477,033 A 12/1995 Bergholtz
5,516,189 A 5/1996 Ligeras
5,543,601 A 8/1996 Bartrug et al.
5,626,021 A 5/1997 Karunasiri et al.
5,643,480 A 7/1997 Gustavsson et al.
5,679,277 A 10/1997 Niibe et al.
5,702,565 A 12/1997 Wu et al.
5,716,536 A * 2/1998 Yokoto ..... H05B 3/84 15/250.003
5,796,044 A 8/1998 Cobian et al.
5,800,483 A 9/1998 Vought
5,800,595 A 9/1998 Wright
5,801,914 A 9/1998 Thrash
5,824,993 A 10/1998 Chrysochoos et al.
5,824,994 A 10/1998 Noda et al.
5,824,996 A 10/1998 Kochman et al.
5,851,588 A 12/1998 Uthoff, Jr.
5,861,610 A 1/1999 Weiss
5,897,162 A 4/1999 Humes et al.
5,902,505 A 5/1999 Finley
5,904,874 A 5/1999 Winter
5,921,314 A 7/1999 Schuller et al.
5,948,297 A 9/1999 Haubner et al.
5,961,869 A 10/1999 Irgens
6,031,214 A 2/2000 Bost et al.
6,054,690 A 4/2000 Petit et al.
6,057,530 A 5/2000 Gurevich
6,064,037 A 5/2000 Weiss et al.
6,070,115 A 5/2000 Oestreicher et al.
6,084,217 A 7/2000 Bulgajewski
6,093,910 A 7/2000 McClintock et al.
6,097,009 A 8/2000 Cole
6,111,234 A 8/2000 Batliwalla et al.
6,124,577 A 9/2000 Fristedt
6,143,206 A 11/2000 Handa et al.
6,147,332 A 11/2000 Holmberg et al.
6,150,642 A 11/2000 Weiss et al.
6,164,719 A 12/2000 Rauh
6,172,344 B1 1/2001 Gordon et al.
6,189,487 B1 2/2001 Owen et al.
6,194,692 B1 2/2001 Oberle
6,215,111 B1 4/2001 Rock et al.
6,220,659 B1 4/2001 McDowell et al.
6,229,123 B1 5/2001 Kochman et al.
6,278,090 B1 8/2001 Fristedt et al.
6,294,758 B1 9/2001 Masao et al.
6,307,188 B1 * 10/2001 Bulgajewski ..... H05B 3/14 219/505
6,369,369 B2 4/2002 Kochman et al.
6,415,501 B1 7/2002 Schlesselman
6,423,951 B1 7/2002 Elsasser
6,426,485 B1 * 7/2002 Bulgajewski ..... H05B 3/845 219/219
6,439,658 B1 8/2002 Ganz et al.
6,452,138 B1 9/2002 Kochman et al.
6,455,823 B1 9/2002 Bulgajewski et al.
6,483,087 B2 11/2002 Gardner et al.
6,495,809 B2 12/2002 Bulgajewski et al.
6,501,055 B2 12/2002 Rock et al.
6,512,203 B2 1/2003 Jones et al.
6,559,422 B2 5/2003 Burt
RE38,128 E 6/2003 Gallup et al.
6,619,736 B2 9/2003 Stowe et al.
6,629,724 B2 10/2003 Ekern et al.
6,664,512 B2 12/2003 Horey et al.

(56) References Cited

U.S. PATENT DOCUMENTS

| | | | | |
|---|---|---|---|---|
| 6,664,518 | B2 | 12/2003 | Fristedt et al. | |
| 6,676,207 | B2 | 1/2004 | Rauh et al. | |
| 6,686,562 | B1 | 2/2004 | Weiss et al. | |
| 6,710,303 | B1 | 3/2004 | Lorenzen | |
| 6,713,733 | B2 | 3/2004 | Kochman et al. | |
| 6,838,647 | B2 | 1/2005 | Nagele | |
| 6,840,576 | B2 | 1/2005 | Ekern et al. | |
| 6,857,697 | B2 | 2/2005 | Brennan et al. | |
| 6,869,139 | B2 | 3/2005 | Brennan et al. | |
| 6,869,140 | B2 | 3/2005 | White et al. | |
| 6,872,882 | B2 | 3/2005 | Fritz | |
| 6,884,965 | B2 | 4/2005 | Nelson et al. | |
| 6,892,807 | B2 | 5/2005 | Fristedt et al. | |
| 6,893,086 | B2 | 5/2005 | Bajic et al. | |
| 6,906,293 | B2 | 6/2005 | Schmiz et al. | |
| 6,976,734 | B2 | 12/2005 | Stoewe | |
| 7,019,260 | B1 | 3/2006 | Degand et al. | |
| 7,020,420 | B2 | 3/2006 | Berg et al. | |
| 7,036,283 | B2 | 5/2006 | Halas | |
| 7,040,710 | B2 | 5/2006 | White et al. | |
| 7,052,091 | B2 | 5/2006 | Bajic et al. | |
| 7,053,344 | B1 * | 5/2006 | Surjan | H05B 3/34 219/217 |
| 7,083,227 | B2 | 8/2006 | Brennan et al. | |
| 7,100,978 | B2 | 9/2006 | Ekern et al. | |
| 7,131,689 | B2 | 11/2006 | Brennan et al. | |
| 7,147,279 | B2 | 12/2006 | Bevan et al. | |
| 7,168,758 | B2 | 1/2007 | Bevan et al. | |
| 7,202,444 | B2 | 4/2007 | Bulgajewski | |
| 7,205,510 | B2 | 4/2007 | Howick | |
| 7,213,876 | B2 | 5/2007 | Stoewe | |
| 7,223,948 | B2 | 5/2007 | Howick et al. | |
| 7,285,748 | B2 * | 10/2007 | Nelson | B60N 2/5685 219/212 |
| 7,301,441 | B2 | 11/2007 | Inada et al. | |
| 7,306,283 | B2 | 12/2007 | Howick et al. | |
| 7,338,117 | B2 | 3/2008 | Iqbal et al. | |
| 7,356,912 | B2 | 4/2008 | Iqbal et al. | |
| 7,370,911 | B2 | 5/2008 | Bajic et al. | |
| 7,475,938 | B2 | 1/2009 | Stoewe et al. | |
| 7,478,869 | B2 | 1/2009 | Lazanja et al. | |
| 7,500,536 | B2 * | 3/2009 | Bulgajewski | H05B 3/34 177/136 |
| 7,506,938 | B2 | 3/2009 | Brennan et al. | |
| 7,510,239 | B2 | 3/2009 | Stowe | |
| 7,560,670 | B2 | 7/2009 | Lorenzen et al. | |
| 7,569,795 | B2 | 8/2009 | Ferguson | |
| 7,587,901 | B2 | 9/2009 | Petrovski | |
| 7,618,089 | B2 | 11/2009 | Stoewe et al. | |
| 7,637,569 | B2 | 12/2009 | Krobok et al. | |
| 7,741,582 | B2 | 6/2010 | Howick et al. | |
| 2002/0117495 | A1 | 8/2002 | Kochman et al. | |
| 2003/0111454 | A1 | 6/2003 | Ishiyama et al. | |
| 2004/0021346 | A1 | 2/2004 | Morinet et al. | |
| 2004/0065656 | A1 | 4/2004 | Inagawa et al. | |
| 2004/0100131 | A1 | 5/2004 | Howick et al. | |
| 2005/0115956 | A1 | 6/2005 | Wong | |
| 2005/0242081 | A1 | 11/2005 | Howick | |
| 2006/0015801 | A1 | 1/2006 | Suh et al. | |
| 2006/0138810 | A1 | 6/2006 | Knoll et al. | |
| 2006/0158011 | A1 | 7/2006 | Marlovits et al. | |
| 2007/0176471 | A1 | 8/2007 | Knoll | |
| 2008/0011732 | A1 | 1/2008 | Ito et al. | |
| 2009/0184107 | A1 | 7/2009 | Weiss | |
| 2009/0218855 | A1 | 9/2009 | Wolas | |
| 2010/0035356 | A1 | 2/2010 | Shalyt et al. | |
| 2010/0038356 | A1 | 2/2010 | Fukuda et al. | |
| 2010/0038357 | A1 * | 2/2010 | Fukuda | H01C 7/021 219/553 |
| 2010/0219664 | A1 * | 9/2010 | Howick | B60N 2/5678 297/180.12 |
| 2010/0326976 | A1 | 12/2010 | Nakajima et al. | |
| 2011/0049131 | A1 | 3/2011 | Sturgess | |
| 2011/0147357 | A1 | 6/2011 | Bokelmann et al. | |
| 2011/0226751 | A1 * | 9/2011 | Lazanja | B60N 2/5685 219/217 |
| 2011/0290775 | A1 | 12/2011 | Cubon et al. | |
| 2012/0049586 | A1 | 3/2012 | Yoshimoto et al. | |
| 2012/0228903 | A1 | 9/2012 | Abe et al. | |
| 2013/0068748 | A1 | 3/2013 | Csonti et al. | |
| 2013/0106147 | A1 | 5/2013 | Lazanja et al. | |
| 2013/0186884 | A1 | 7/2013 | Barfuss | |

FOREIGN PATENT DOCUMENTS

| | | | |
|---|---|---|---|
| EP | 0202896 | A2 | 5/1986 |
| GB | 2010650 | A | 6/1979 |
| JP | 56093284 | A | 7/1981 |
| JP | 57134655 | A | 8/1982 |
| JP | 62109385 | A | 7/1987 |
| JP | 11-24493 | A | 1/1999 |
| JP | 11-218336 | A | 8/1999 |
| JP | 2000333781 | A | 12/2000 |
| JP | 2002050459 | A | 2/2002 |
| JP | 2004055219 | A | 2/2004 |
| WO | 8906480 | A1 | 7/1989 |
| WO | 94/09684 | A1 | 5/1994 |
| WO | 9701549 | A1 | 1/1997 |
| WO | 01/43507 | A1 | 6/2001 |
| WO | 02/06914 | A1 | 1/2002 |
| WO | 03/101777 | | 12/2003 |
| WO | 2005/047056 | | 5/2005 |
| WO | 2010/065411 | A1 | 6/2010 |

OTHER PUBLICATIONS

Potentially related Patent Application, U.S. Appl. No. 13/737,590, filed Jan. 9, 2013, published as 2013/0186884.
Potentially related Patent Application, U.S. Appl. No. 13/621,890, filed Sep. 18, 2012, published as 2013/0068748.
Potentially related Patent Application, U.S. Appl. No. 12/338,971, filed Dec. 18, 2008, published as 2009/0184107.
Potentially related Patent Application, U.S. Appl. No. 12/963,030, filed Dec. 8, 2010, published as 2011/0147357.
Potentially related Patent Application, U.S. Appl. No. 10/715,160, filed Nov. 17, 2003, U.S. Pat. No. 7,306,283.
Potentially related Application, U.S. Appl. No. 11/923,091, filed Oct. 24, 2007, U.S. Pat. No. 7,741,582.
Potentially related Patent Application, U.S. Appl. No. 12/778,238, filed May 12, 2010, published as U.S. Pat. No. 2010/0219664.
Potentially related Patent Application, U.S. Appl. No. 13/106,148, filed May 12, 2011, published as U.S. Pat. No. 2011/0226751.
Potentially related Patent Application, U.S. Appl. No. 13/256,318, published as U.S. Pat. No. 2013/0106147 on May 2, 2013.
Potentially related Patent Application, U.S. Appl. No. 13/737,590, filed Jan. 9, 2013, published as U.S. Pat. No. 2013/0186884.
Potentially related Patent Application, U.S. Appl. No. 13/621,890, filed Sep. 18, 2012, published as U.S. Pat. No. 2013/0068748.
Potentially related Patent Application, U.S. Appl. No. 12/338,971, filed Dec. 18, 2008, published as U.S. Pat. No. 2009/0184107.
Potentially related Patent Application, U.S. Appl. No. 12/963,030, filed Dec. 8, 2010, published as U.S. Pat. No. 2011/0147357.

* cited by examiner

ELECTRICAL HEATING DEVICE

BACKGROUND OF THE INVENTION

The subject matter according to the present invention is an electrical heating device according to an electrical heating device. It can be used, for example, for heating user contact surfaces, such as seats, armrests and steering wheels.

PRIOR ART

Textile heating elements are known. The disadvantage is the quite high cost of their manufacture.

Film heating elements with ah electrically conductive printed coating are also known. The disadvantage is that such heating elements are often unable to withstand use in the field.

Therefore, it is desirable to further develop the prior art, particularly with regard to a simple manufacture and a high resistance.

SUBJECT MATTER OF THE INVENTION

Against this background, a technical concept having the characteristics of an electrical heating device having at least one electrical heating resistor and at least one contacting device. Further advantageous embodiments can be obtained from the other claims and the subsequent description.

FIGURES

Below, details of the invention are explained. These embodiments are intended to make the invention understandable. However, they only have the character of examples. Obviously, within the framework of the invention defined by the independent claims, one of more described characteristics can also be omitted, modified or completed. Moreover, the characteristics of different embodiments can obviously also be combined with one another. The decisive factor is that the concept of the invention is substantially implemented. If a characteristic is to be at least met in part, this includes that this characteristic is also completely satisfied, or substantially completely met. "Substantially" here means in particular that the implementation allows an achievement of the desired benefit to a recognizable extent. This can mean, in particular, that a corresponding characteristic is at least 50%, 90%, 95% or 99% implemented. If a minimum amount is, indicated, then more than this minimum amount can obviously also be used. If the number of a component is indicated to he at least one, then this also includes particular embodiments having two, three or another plurality of components. A description made for an object can also be applied to the predominant portion or the totality of all other similar objects. Unless otherwise indicated, the intervals include their end points. Below, reference is made to:

BREIF DESCRIPTION OF THE DRAWINGS

FIG. 1 Vehicle 1 with a heating device 10 according to the invention.

Figure 2:
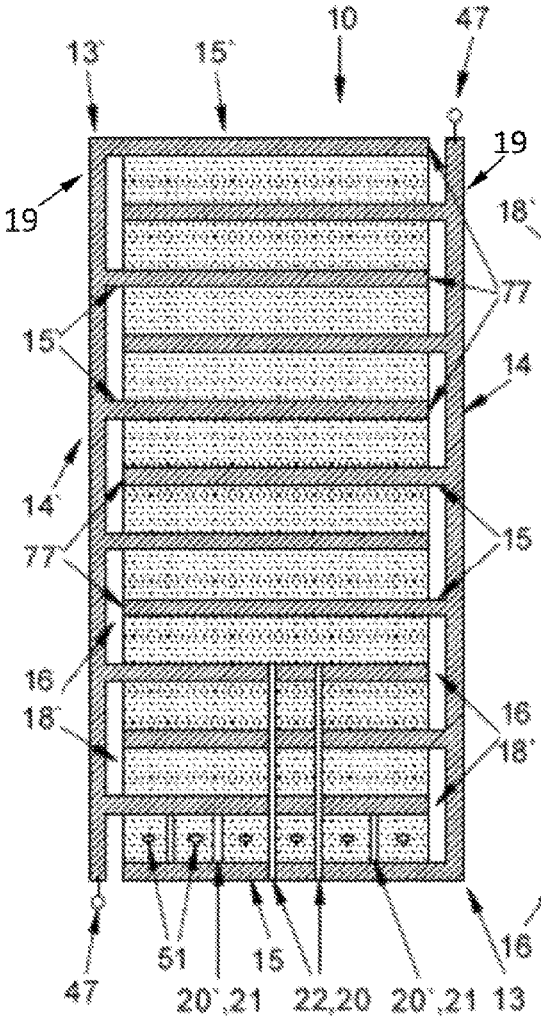

FIG. 2 Top view of a heating device with different variants for connecting a main electrode to a heating resistor.

Figure 3A:
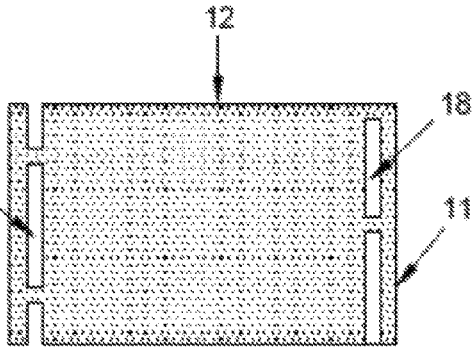
Figure 3B:
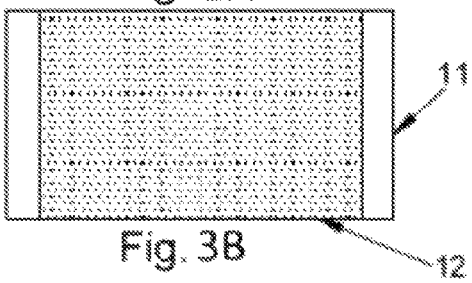
Figure 3C:
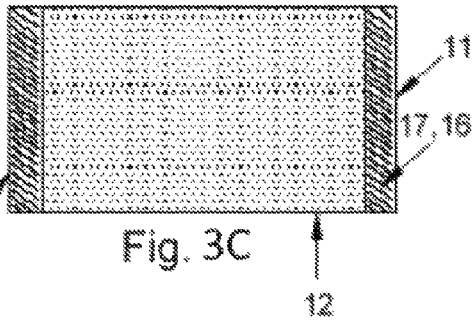

FIGS. 3A-3C Top view of the heating device of FIG. 2 without contacting devices.

DESCRIPTION

The subject matter of the invention includes a vehicle 1. A vehicle 1 denotes a device for transporting persons and/or goods. Examples are land, water, rail or air travel vehicles, particularly airplanes, ships and motor vehicles.

The invention also relates to an interior furnishing 2. An interior finishing 2 denotes a component with which the user of the passenger cell can come in contact. Examples are a steering device 3 for vehicles, a dashboard 30, an arm rest, a door lining, a seat-contact surface, a warming blanket, a roof lining, a cushion, a covering or a seat 4.

An embodiment of the invention also relates to a steering device 3. A steering device 3 denotes a device by means of which signals for steering a vehicle can be transmitted by the user to the vehicle 1. Examples are steering wheels of motor vehicles, control sticks of airplanes and/or handle bars of motorcycles.

An interior furnishing 2 preferably has a cushion 44 for a springy support for a user. A cushion denotes a device for damping impacts and/or for the distribution of local pressure peaks over a larger area. Examples are blocks made of foamed polyurethane.

An interior finishing 2 preferably has a covering 45. A covering denotes a single layer or multiple layer fabric which is arranged at least in sections on the surface of an object and/or covers the latter at least partially, particularly in order to decorate it or protect it against mechanical stress. Examples are perforated or imperforated as well as air permeable or air impermeable layers made of a film or textile.

The invention also relates to a heating device 10 for a rapid or long-lasting warming of a user or of an object-to be warmed, particularly an interior space housing, an interior portion, a seat and/or a steering wheel.

A heating device 10 denotes a device which, for the controlled warming of its environment, produces thermal energy and releases it conductively, convectively and/or by heat radiation to its environment. It is positioned preferably directly on the bottom side of a covering or on the inner side of a housing lining, particularly between a cushion and a covering.

However, it is preferable but not required that a heating device 10 comprises at least one heating resistor support 11 for stabilizing a heating resistor and for a permanent positioning of the heat source. It is made preferably at least partially from a material that has a low price and/or a good thermal conductivity. Examples are polymers, particularly polyamide, polyester, polyurethane or polycarbonate. It is advantageous to use fabrics, made at least partially from a textile, knitted and crocheted fabric, knitted fabric, woven fabric, nonwoven fabric, flexible thermoplastics, air permeable material and/or a stamped or dimpled film, flat components or multiple layered composite modules. Flame retardant or self-extinguishing materials are advantageous.

Preferably a heating device 10 has at least one heating resistor 12 for a direct or indirect warming of a regulation zone. A heating resistor 12 denotes an ohmic resistance which, when current flows through it, converts electrical energy to thermal energy. Examples here are fabrics, electrically conductive layers, for example, polymer films, or metal films or coatings. Its material comprises, for example, at least portions made of aluminum, copper, gold, silver or chromium nickel, and conductive paints. It preferably has an electrical surface resistance of 10-500 ohm, particularly 50-150 ohm, and particularly 190-210 ohm. In the case of laminar heat resistances, it is possible for the heat resistance to be identical to the heat resistance support, particularly in the case of a matrix of conductive and nonconductive constituents.

Preferably, a material is selected which results in conductivity of the entire heating resistor cross section. The purpose of this is an increased ability to carry current in comparison, for example, to that achievable by printing on a nonconductive heat resistance support. Examples are conductive films made of a polymer material with conductive particles which are admixed during the manufacture of the film. It is particularly preferable to use a resin matrix consisting at least partially of PP, PE, PS, PET or PU, and to which are admixed particles or fibers with carbon, soot or metal, for example, silver, nickel, copper or tin. Combustible components should be minimized or protected by additional fire protection measures.

A heating device 10 comprises at least one contacting device 13 for connecting a heating resistor to an external supply voltage. Usually there are two contacting devices 13, 13'. However, it is also possible to use more of such contacting devices. Their shape results in a uniform current flow in the entire heating area of the heating resistor. Comb-like structures are preferred.

A contacting device 13 preferably has at least one main electrode 14, 14'. Main electrode 14 denotes a device for distributing electrical current from a current source 47 to a plurality of branch electrodes 15,15'. A suitable shape favors a low transition resistance in order to prevent hot spots, and it moreover prevents tracings on the covering top side for a high haptic comfort. Relevant examples are electrically conductive, particularly self-supporting bands 19. Their length corresponds preferably to the length of the longitudinal side of a cushion or of a heating resistor. Their width allows a sufficiently reliable contacting. Relevant examples are 0.2-3 cm, and particularly 0.5-2 cm.

Preferably at least one main electrode 14 has a position which results in a large-surface supply with current, wherein a direct transition from the main electrode 14 into the heating resistor 12 can be avoided if desired. Examples are, along a heating resistor:

B. at a distance from said heating resistor, on the base surface of a nonelectrically conductive heating resistor support, as in FIG. 3B;

C. on the base surface of the heating resistor, but separated from the heating resistor 12 by an electrode insulation, as in FIG. 3C, or A. on the base surface of the heating resistor and connected in an electrically conductive manner to said heating resistor, as in FIG. 3A.

Preferably, at least one main electrode 14 comprises a metal which allows a low transition resistance between the contacting device and the heating resistor, in order to achieve a good current input and in order to prevent hot spots on electrodes. Examples are band-shaped textiles or films, which are manufactured at least partially from a conductive polymer or metal, particularly aluminum or copper, or coated therewith. Solid metal bands coated with electrically conductive or nonconductive adhesives, or layers made exclusively from such an adhesive or such a metal band are particularly well suited. In the case of an embodiment according to FIG. 3A, it is desirable for a copper film with an adhesive layer that is electrically insulating with respect to the heating resistor 12 to be applied as insulation layer on the heating resistor 12, so that the main electrode 14 can be insulated from the heating resistor 12. In addition, it is advantageous if a main electrode comprises at least two conductive layers that overlap at least partially over one another.

Preferably, at least one contacting device 13 has at least one branch electrode 15. A branch electrode 15 denotes a device for feeding a current from a main electrode into a heating resistor 12. The number of branch electrodes is preferably selected in such a manner that a large-surface distribution of the current and a generation of the correct local resistances are possible. A suitable number is between 2 and 200 pieces for each heating resistor 12, particularly one piece for each approximately 3-5 cm. The shape and the material can be selected in principle as for a main electrode 14, wherein, however, a conductive material of the branch electrode 15 is preferably different from a conductive material of the main electrode. It is particularly advantageous if a branch electrode 15 comprises at least constituents made of aluminum, and a main electrode comprises at least constituents made of copper. The branch electrodes extend preferably from a first main electrode 14, 14' almost to a facing second main electrode 14, 14'. Their alignment extends preferably transversely to the course of the main electrode 14, 14'. In order to achieve a low transition resistance between the branch electrode 15, 15' and its main superimposed electrode, sections, in particular one end section, of at least one branch electrode 15 are arranged between two electrically conductive layers of an associated main electrode, preferably between two copper-containing layers. Some of the participating conductive layers or all these layers can be connected to each other with an electrically conductive adhesive.

For a low transition resistance between a branch electrode 15 and a heating resistor 12 contacted by it, it is advantageous to use electrically conductive bands that are stuck, at least in sections, with an electrically conductive adhesive onto the heating resistor 12, for example, in the form of a self-adhesive band with a metal support film, or they are attached instead or additionally by sewing, lamination or injection.

It is advantageous if a heating resistor 12 or a heating resistor support 11 already contains adhesive constituents or becomes adhesive at least briefly as a result of heating or another physical or chemical treatment, and the branch electrode can be embedded therein at least partially without recourse to another material.

Preferably, a heating device 10 comprises a current diverting device 16. A current deflection device denotes any structure that diverts a current flow from a branch electrode 15 of a contacting device 13 in a main electrode 14 of another contacting device 13' to a branch electrode 15' of this other contacting device 13'. This results in a sufficiently high resistance between the branch electrodes of a contacting device and a main electrode 14 of another contacting device. This in turn prevents hot spots.

Preferably, a current deflection device comprises an electrode insulation 17. An electrode insulation 17 denotes any device that inhibits the passage of electrical current into or out of the main electrode. This produces an at least local insulation of a main electrode with respect to a heating resistor 12, so that no current is fed there from this main electrode directly into the heating resistor 12, but only through branch electrodes supplied by the main electrode. This too prevents hot spots. Suitable materials are, for example, insulation layers made of electrically nonconductive films, nonconductive adhesives or air gaps and separations of an electrode with respect to a heating resistor 12. It is preferable to use double-sided adhesive bands with an insulating support layer or layers made of nonconductive adhesive on the electrode and/or the heating resistor 12. It is easy to manufacture layers that are arranged in a sandwich-like pattern between a heating resistor 12 and a main electrode arranged above the base surface of said heating resistor.

Preferably, a current deflection device 16 comprises a pole separation device 18, 18', in order to produce a sufficient electrical separation of two oppositely poled contacting devices. Examples are material recesses, stamped out sections, and separations or barrier resistances in a heating resistor material or between two contacting devices, particularly between the main electrode 14 and a tip 77 of an opposite poled branch electrode 15.

The width of a pole separation device 18 is selected such that, on the one hand, the branch electrode 15 of a contacting device 13 is as close as possible to the main electrode of an opposite poled contacting device, while a reliable pole separation is provided at the same time. The purpose is an optimal use of the material of the heating resistor. Examples are 1-15 mm, particularly 2-7 mm, and particularly 3-5 mm. Here, the shortest bypass path to bypass the pole separation device 18 should be at least as long as the shortest separation between two counter oppositely poled branch electrodes on the heating resistor 12.

Preferably, a heating device 10 has a protective sheath (not shown) for covering the heating device towards the covering and/or towards the cushion. The effect of this is protection from mechanical damage and from corrosion, and/or decoration or insulation. Examples are textiles, such as nonwoven fabrics, or films, which are formed at least partially by waterproof materials such as PE, PP, PU or PET. In the case of an appropriate selection, they can also be flame retardant or self-extinguishing.

Preferably, a heating device 10 has a comfort perforation 51 for permeability to air and moisture, and an adjusted heating resistor value. Examples are circular, oval or longitudinal holes in the heating device 10, particularly in a heating resistor 12.

Preferably, a heating device 10 comprises a flame retardant device 20, 20'. A flame retardant device 20 denotes a device that extinguishes a fire, or delays or deflects its propagation.

The flame retardant device 20 preferably has a fire propagation blocker 22 for extinguishing or pushing away flames or embers, on the propagation blocker, for example, in the form of incombustible or self-extinguishing material bands or strips. Their arrangement occurs particularly transversely to at least one branch electrode 15, preferably with parallel offset with respect to a main electrode and over several branch electrodes. Suitable materials are metals, particularly aluminum.

Preferably, a flame retardant device 20 has a flame retardant recess 21, which, in terms of a fire, means removal of combustible material, and thus produces a delay or the extinguishing of the fire, in a cost saving manner. Examples are gaps with a width of 5 mm or more in a heating resistor 12 or in a component that works together with said resistance.

The invention claimed is:

1. An electrical heating device comprising:

a heating resistor comprising a contacting device connecting the heating resistor to a current source, the contacting device includes a main electrode and a plurality of branch electrodes, the main electrode distributing current from the current source to the plurality of branch electrodes, wherein the heating resistor comprises one or more fire retardant recesses defining one or more air gaps, and wherein the heating device comprises one or more fire propagation blocker strips extending transversely to at least one of the plurality of branch electrodes.

2. The heating device according to claim 1, wherein the heating resistor is manufactured at least partially from a combustible material.

3. The heating device according to claim 1, wherein the one or more fire propagation blocker strips are formed at least partially by a noncombustible or a self-extinguishing material, and wherein the one or more fire propagation blocker strips are offset generally parallel to the main electrode.

4. The beating device according to claim 1, wherein the contacting device comprises at least two electrically conductive layers that overlap at least partially over one another.

5. The heating device according to claim 1, wherein the main electrode is a self-supporting band, which is stuck to the heating resistor.

6. An electrical heating device comprising:

a heating resistor comprising a contacting device connecting the heating resistor to a current source, the contacting device includes a main electrode and a plurality of branch electrodes branching from the main electrode, wherein the heating resistor comprises one or more fire retardant recesses defining one or more air gaps in the heating resistor, wherein the heating device comprises one or more fire propagation blocker strips extending transversely to at least one of the plurality of branch electrodes, and wherein the contacting device comprises at least two electrically conductive layers that overlap at least partially over one another.

7. A vehicle, wherein the vehicle comprises at least one heating device according to claim 1.

8. The heating device according to claim 4, wherein the one or more fire propagation blocker strips are formed at least partially by a noncombustible or a self-extinguishing material.

9. The heating device according to claim 3, wherein the contacting device comprises at least two electrically conductive layers that overlap at least partially over one another.

10. The heating device according to claim 6, wherein the main electrode comprises at least one self-supporting band, which is stuck to the heating resistor.

11. The heating device according to claim 9, wherein the contacting device comprises at least one self-supporting band, which is stuck to the heating resistor.

12. The heating device according to claim 11, wherein the main electrode comprises a first conductive material, and the plurality of branch electrodes are formed at least partially by a second conductive material that is chemically different from the first conductive material of the main electrode.

13. An electrical heating device comprising:

a. at least one electrical heating resistor including:

i. at least one flame retardant recess, ii. at least one fire propagation blocker, which is formed at least partially by a noncombustible or a self-extinguishing material, and b. at least one contacting device including:

i. at least two electrically conductive layers that overlap at least partially over one another, ii. at least one self-supporting band, which is stuck to the at least one electrical heating resistor, iii. a main electrode with a first conductive material, and in that the contacting device comprises branch electrodes branching off the main electrode, which are formed at least partially by a second conductive material that is chemically different from the first conductive material of the main electrode wherein the heating resistor is manufactured at least partially from a combustible material and in that the heating device comprises at least one flame retardant device.

14. The heating device according to claim 1, wherein the main electrode comprises an electrode insulation so that current is prevented from directly transferring from the main electrode to the heating resistor, and wherein the current is transferred to the heating resistor with the plurality of branch electrodes.

15. The heating device according to claim 1, wherein the heating device comprises at least one heating resistor support for stabilizing the heating resistor, and wherein the at least one heating resistor support comprises a flame retardant or self-extinguishing material.

16. The heating device according to claim 13, wherein the at least one fire propagation blocker comprises at least one strip that is offset generally parallel to the main electrode.

17. The heating device according to claim 13, wherein the at least one flame retardant recess comprises at least one air gap in the at least one electrical heating resistor.

18. The heating device according to claim 6, wherein the main electrode comprises a first conductive material, and the plurality of branch electrodes are formed at least partially by a second conductive material that is chemically different from the first conductive material of the main electrode.

* * * * *